US007323667B2

(12) United States Patent
Dooley

(10) Patent No.: US 7,323,667 B2
(45) Date of Patent: Jan. 29, 2008

(54) CURIE TEMPERATURE THERMOSTAT FOR A EDDY CURRENT HEATING DEVICE AND METHOD

(75) Inventor: Kevin Allan Dooley, Mississauga (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 0 days.

(21) Appl. No.: 11/082,951

(22) Filed: Mar. 18, 2005

(65) Prior Publication Data

US 2006/0219706 A1 Oct. 5, 2006

(51) Int. Cl.
*H05B 6/10* (2006.01)
*H05B 6/06* (2006.01)

(52) U.S. Cl. ..... 219/630; 219/631; 219/667; 219/670

(58) Field of Classification Search ..... 219/628–631, 219/634–635, 660–670, 649
See application file for complete search history.

(56) References Cited

U.S. PATENT DOCUMENTS

| | | | | |
|---|---|---|---|---|
| 2,547,934 A | | 4/1951 | Gill | |
| 2,701,092 A | | 2/1955 | Henshaw | |
| 3,272,956 A | * | 9/1966 | Baermann | 219/645 |
| 3,445,616 A | * | 5/1969 | Guyer | 219/628 |
| 3,790,735 A | * | 2/1974 | Peters, Jr. | 219/622 |
| 3,812,441 A | | 5/1974 | Sakamoto et al. | |
| 3,895,328 A | | 7/1975 | Kato et al. | |
| 3,903,492 A | | 9/1975 | Endo et al. | |
| 4,039,794 A | * | 8/1977 | Kasper | 219/618 |
| 4,411,715 A | | 10/1983 | Brisken et al. | |
| 4,482,293 A | | 11/1984 | Perry | |
| 4,486,638 A | | 12/1984 | de Bennetot | |
| 4,769,519 A | * | 9/1988 | Hall | 219/667 |
| 4,896,756 A | | 1/1990 | Matsushita | |
| 4,897,518 A | | 1/1990 | Mucha et al. | |
| 5,397,948 A | | 3/1995 | Zoerner et al. | |
| 5,508,496 A | * | 4/1996 | Hansen et al. | 219/633 |
| 5,558,495 A | | 9/1996 | Parker et al. | |
| 5,742,106 A | | 4/1998 | Muraji | |
| 5,746,580 A | | 5/1998 | Parker et al. | |
| 5,793,137 A | | 8/1998 | Smith | |
| 5,801,359 A | | 9/1998 | Mano et al. | |
| 5,907,202 A | | 5/1999 | Muraji | |
| 6,180,928 B1 | | 1/2001 | Garrigus | |
| 6,232,585 B1 | * | 5/2001 | Clothier et al. | 219/620 |
| 6,250,875 B1 | | 6/2001 | Bauer et al. | |
| 6,296,441 B1 | | 10/2001 | Gozdawa | |
| 6,313,560 B1 | | 11/2001 | Dooley | |
| 6,503,056 B2 | | 1/2003 | Eccles et al. | |
| 6,543,992 B2 | | 4/2003 | Webster | |
| 6,607,354 B1 | | 8/2003 | Klapatch et al. | |

(Continued)

FOREIGN PATENT DOCUMENTS

DE 4226291 * 2/1994

(Continued)

*Primary Examiner*—Philip H. Leung
(74) *Attorney, Agent, or Firm*—Ogilvy Renault LLP

(57) ABSTRACT

The device and method are used for controlling eddy currents generated by an electro-magnetic heater having at least one magnetic field producing element. To control the heater, a source of heat is used to heat a Curie temperature material, located adjacent to the magnetic field producing element. This prevents heat from being generated in the object being heated.

3 Claims, 2 Drawing Sheets

U.S. PATENT DOCUMENTS

| | | | | |
|---|---|---|---|---|
| 6,630,650 | B2 | 10/2003 | Bassill et al. | |
| 6,664,705 | B2 | 12/2003 | Dooley | |
| 2003/0102304 | A1* | 6/2003 | Boyers | 219/628 |
| 2004/0060927 | A1* | 4/2004 | Kim et al. | 219/624 |
| 2004/0089435 | A1* | 5/2004 | Wang | 164/113 |

FOREIGN PATENT DOCUMENTS

| | | | |
|---|---|---|---|
| EP | 0 836 007 | A1 | 4/1998 |
| JP | 61-75897 | * | 4/1986 |

* cited by examiner

CURIE TEMPERATURE THERMOSTAT FOR A EDDY CURRENT HEATING DEVICE AND METHOD

TECHNICAL FIELD

The technical field of the invention relates generally to a Curie temperature thermostat and a method for controlling eddy currents used for heating.

BACKGROUND OF THE ART

Eddy currents heaters are used as a source of heat in some devices. However, most of these electromagnetic heaters include permanent magnets for generating the magnetic field that induces the eddy currents. Other heaters may use electromagnets that cannot be controlled from the exterior. As a result, it is thus not possible to control the heat generation without moving the magnets away from the conductive surface in which eddy currents are created, or change the speed at which the magnetic field is moved.

Overall, it would be highly desirable to control the electromagnetic heaters so as to shut off or reduce their heat generation capacity when, for instance, the part being heated reaches its optimum or maximum temperature. Known solutions are restrictive in terms of flexibility of design, since only a few materials have Curie temperatures and so the designer has been limited with existing designs. Room for improvement is available.

SUMMARY OF THE INVENTION

An electromagnetic heater can be controlled when the magnetic field is conducted through a material having a Curie temperature. As a result, the magnetic field can be interrupted or lowered whenever the Curie temperature material is heated at or above its Curie point.

In one aspect, the present invention provides a device for controlling an eddy current heater, the heater comprising at least one magnetic field producing element, the device comprising: a Curie temperature material located adjacent to the magnetic field producing element; and a source of heat to selectively heat the Curie temperature material above the Curie temperature.

In a second aspect, the present invention provides a device for controlling an eddy current heater, the heater comprising at least one magnetic field producing element, the device comprising: an electromagnetically conductive material located adjacent to the magnetic field producing element, the material having a Curie temperature; and means for heating the material above its Curie temperature.

In a third aspect, the present invention provides a method for controlling a heat generation by an eddy current heater used for heating an object, the method comprising: operating the heater to generate heat in the object; determining that the object has received enough heat; and reducing or interrupting the eddy currents generated by the heater by heating a Curie temperature material above the Curie temperature thereof.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
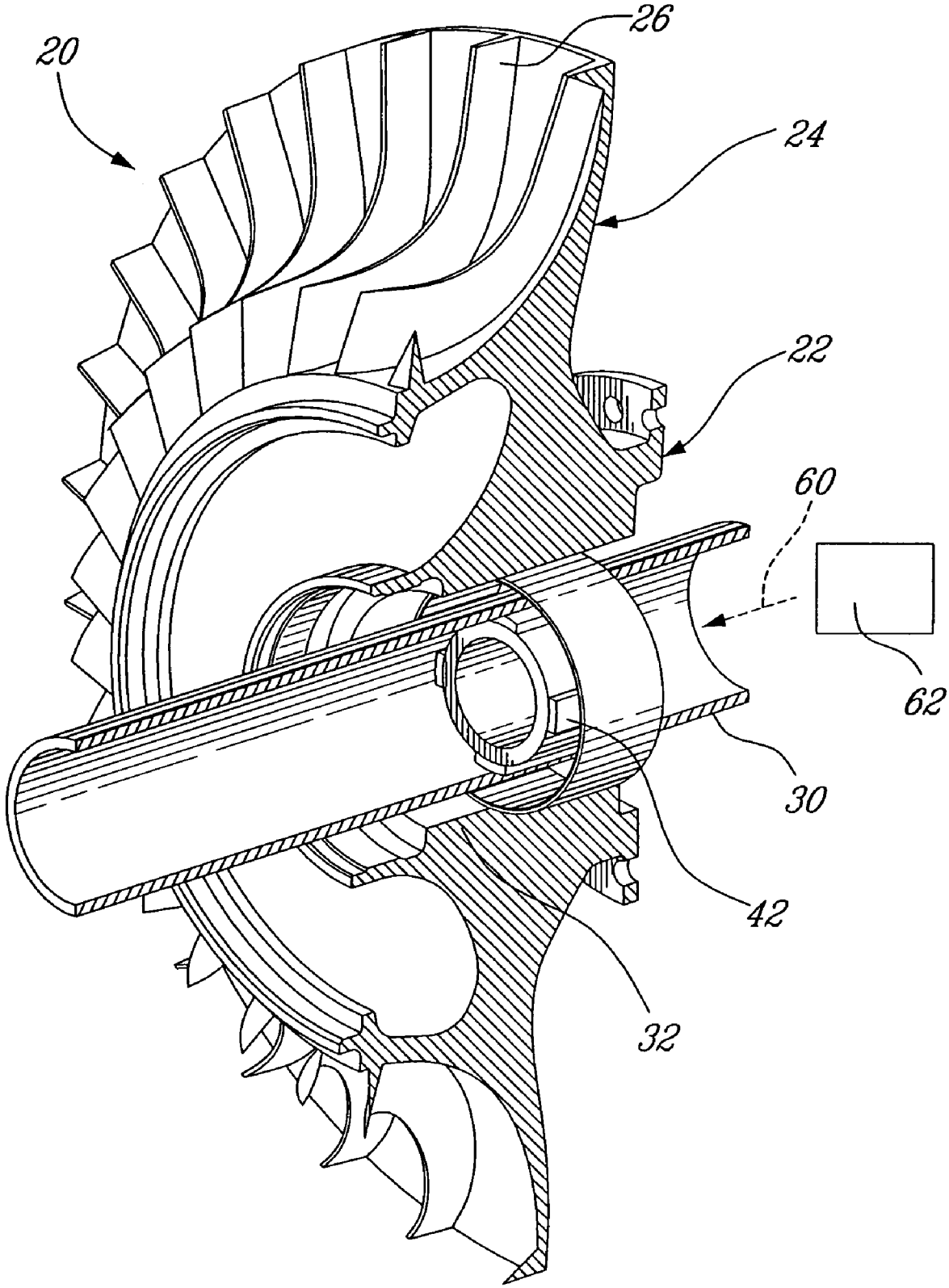
FIG. 1 is a cut-away perspective view of an example rotor with an eddy current heater in accordance with a preferred embodiment of the present invention.

FIG. 1 semi-schematically shows an example of a rotating body or rotor 20, for example an impeller used in a compressor. The rotor 20 comprises a central section, which is generally identified with the reference numeral 22, and an outer section, which outer section is generally identified with the reference numeral 24. The outer section 24 supports a plurality of impeller blades 26. These blades 26 are used for compressing air when the rotor 20 rotates at a high rotation speed. The rotor 20 is mounted for rotation using a main shaft (not shown). In the illustrated example shown in FIGS. 1 to 3, the main shaft includes an interior cavity in which a second shaft, referred to as the inner shaft 30, is coaxially mounted. This configuration is typically used in multi-shaft gas turbine engines. Both shafts rotate at different rotation speeds. The inner shaft 30 extends through a central bore 32 provided in the central section 22 of the rotor 20. Referring briefly to FIG. 1, it should be noted that one can use a single shaft rotating system in which the magnets 42 are held fixed while the rotor 20 and its shaft rotate. In that case, the "inner shaft 30" would be a non-rotating part.

Referring again to FIGS. 1 to 3, the device 40 is provided for heating the central section 22 of the rotor 20 using eddy currents. The electrical conductor is preferably provided at the surface of the central bore 32. The device 40 comprises at least one magnetic field producing element adjacent to the electrical conductive portion, as will now be explained.

Figure 2:
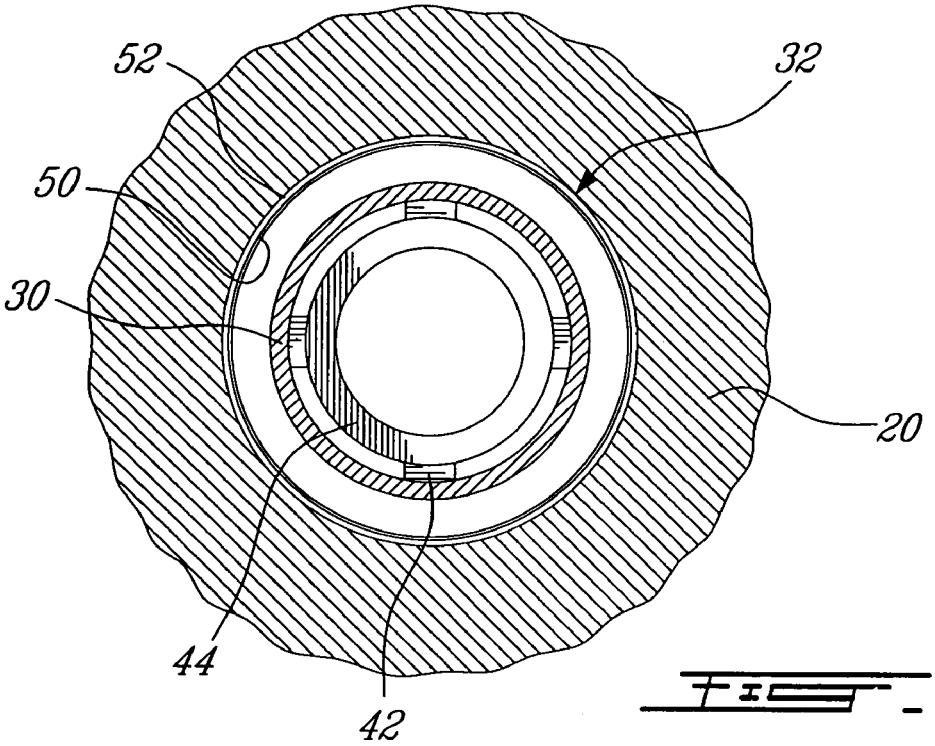
FIG. 2 is a radial cross-sectional view of the rotor and the heater shown in FIG. 1.
Figure 3:
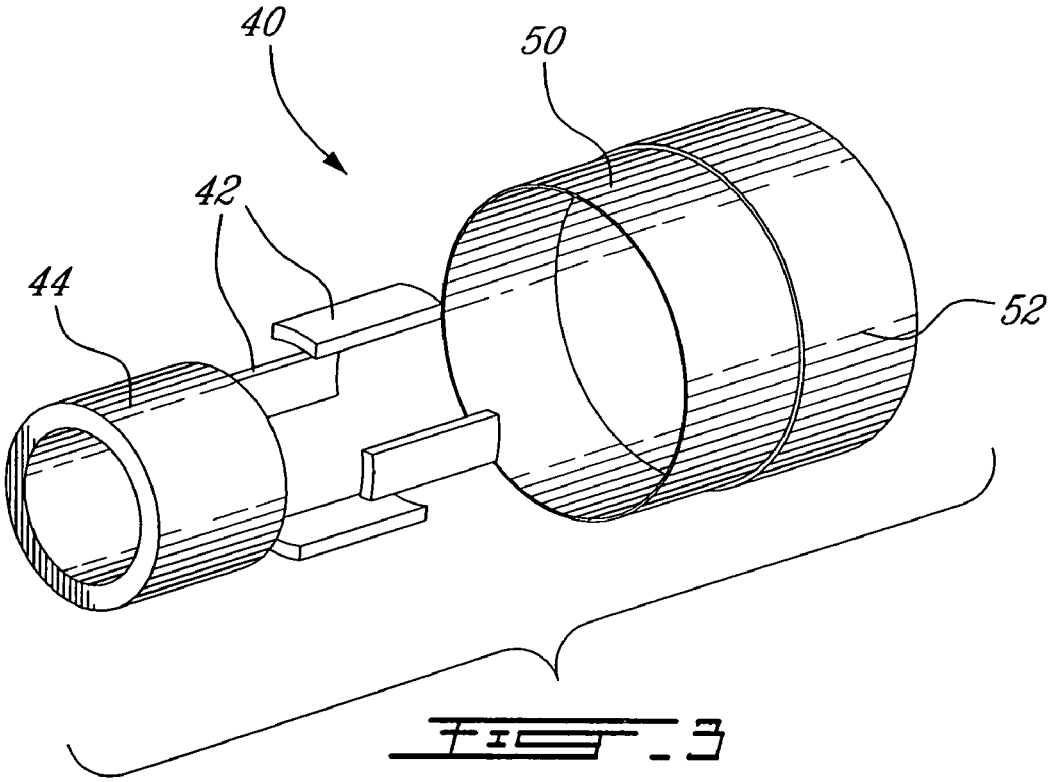
FIG. 3 is an exploded view of the heater shown in FIGS. 1 and 2.

FIGS. 1 to 3 show the device 40 being preferably provided with a set of permanent magnets 42, more preferably four of them, as the magnetic field producing elements. These magnets 42 are made, for instance, of samarium cobalt. They are mounted around a support structure 44, which is preferably set inside the inner shaft 30. Ferrite is one possible material for the support structure 44. The support structure 44 is preferably tubular and the magnets 42 are shaped to fit thereon. The magnets 42 and the support structure 44 are preferably mounted with interference inside the inner shaft 30. The position of the magnets 42 and the support structure 44 is chosen so that the magnets 42 be as close as possible to the electrical conductive portion of the rotor 20 once assembled.

The magnets are capable of creating a moving magnetic field relative to the object to be heated. In this example, the set of magnets 42 and the support structure 44 are mounted on the inner shaft 30 which generally rotates at a different speed with reference to the outer shaft and rotor 20. This magnetic field will circulate around a magnetic circuit including the electrical conductor portion in the central section of the rotor 20, since the inner shaft 30 is made of a magnetically permeable material.

The electrical conductor portion of the central section 22 of the rotor 20 can be the surface of the central bore 32 itself if, for instance, if the rotor 20 is made of a good electrical conductive material. If not, or if the creation of the eddy currents in the material of the rotor 20 is not optimum, a sleeve or cartridge or coating made of a more suitable material can be provided inside the central bore 32. In the illustrated embodiment, the device 40 comprises a cartridge made of two sleeves 50, 52. The inner sleeve 50 is preferably made of cooper, or any other very good electrical conductor. The outer sleeve 52, which is preferably made of steel, or any material having similar properties, is provided for holding the inner sleeve 50. The pair of sleeves 50, 52 can be mounted with interference inside the central bore 32 or be otherwise attached thereto.

In use, the rotor 20 of FIG. 1 rotates at a very high speed and air is compressed by the blades 26. This compression generates heat, which is transferred to the blades 26 and then to the outer section 24 of the rotor 20. However, at the same time, relative rotation between the rotor 20 and the magnets inner shaft 30 creates a moving magnetic field in the inner sleeve 50 attached to the rotor 20, thereby inducing eddy currents therein. The material is then heated and the heat is transferred to the outer sleeve 52 and to the outer section 24 itself. In this example, the invention thus helps heat the central bore 32 of the rotor 20.

As aforesaid, ferrite is one possible material for the support structure 44. Ferrite is a material which has a Curie point. The Curie point can be generally defined as the temperature at which there is a transition between the ferromagnetic and paramagnetic phases. When an electromagnetically conductive material having a Curie point is heated above a temperature referred to as the "Curie temperature", it losses its ferromagnetic properties and becomes a magnetic insulator. This feature can be used to control heat generation by the device 20 once the inner section 22 of the rotor 20 reaches the maximum operating temperature, through the selection of a material having a desired Curie temperature. Accordingly, the support structure 44, when made of ferrite or any other material having a Curie point, can be heated to reduce the eddy currents. In this example, heat is produced using a flow of hot air 60 coming from a section of the engine or mechanical system, with which rotor 20 is associated, and this air is directed inside the inner shaft 30. Thus, heat is supplied to the Curie temperature material controllably in sufficient amount to "shut off" the Curie temperature material when it is determined that the object being heated has received enough heat. Temperature sensors and a controlled heat source 62 can be used for that purpose. Control over the heat generation may otherwise be provided using a timer counting the running time of the engine 10, or any other way, including a manual intervention. Alternately, heat generated simply through the normal operation engine or system with which rotor 20 is associated may be used to automatically heat the Curie temperature material. The material composition may be selected to provide an appropriate or advantageous Curie temperature for the Curie temperature material, as well. Still alternately, the invention may be provide in a configuration such that heat from the object being heated may feedback to the Curie temperature material in order to shut it down. Other possibilities will also be apparent to the skilled reader in light of this description.

The above description is meant to be exemplary only, and one skilled in the art will recognize that changes may be made to the embodiments described without departing from the scope of the invention disclosed. For example, the device can be used with different kinds of rotors than the one illustrated in the appended figures, including turbine rotors. It can also be used in other environments in which relative motion of a magnetic material may be generated, and is not limited to rotating shaft systems, those these are best suited to practising the invention. The rotating system need not be constant speed, not include multiple rotating bodies, nor include shafts, nor be limited to configurations where the magnets rotate or are disposed inside the object to be heated. Any suitable configuration employed the principle taught herein may be used. The Curie temperature material can be set around the magnets or the other magnetic field producing elements. More than one distinct Curie temperature material can be used to obtain different degrees of control. The magnets can be made of a different material than samarium cobalt. The magnets can also be provided in different numbers or with a different configuration than what is shown. The use of electromagnets is also possible. Other materials than ferrite are possible for the Curie temperature material. The heat used to increase the temperature of the Curie temperature material can come from a different source than a source of hot air. For instance, an electrical element can be used for that purpose. Still other modifications which fall within the scope of the present invention will be apparent to those skilled in the art, in light of a review of this disclosure, and such modifications are intended to fall within the appended claims.

What is claimed is:

1. A method for controlling a heat generation by a permanent magnets heater used for heating an object, the method comprising:

operating the heater to generate heat in the object;

determining that the object has received enough heat; and reducing or interrupting the eddy currents generated by the permanent magnets heater by heating a Curie temperature material above the Curie temperature thereof.

2. The method as defined in claim 1, wherein the Curie temperature material is heated using a source of hot gas.

3. method as defined in claim 2, wherein the Curie temperature material is heated using heat feedback from the object.

* * * * *